United States Patent [19]

Brown

[11] Patent Number: 5,030,031

[45] Date of Patent: Jul. 9, 1991

[54] DAMMING AND BARRIER-FORMING DEVICE AND METHOD

[76] Inventor: Howard L. Brown, Rte. #1, Box 44, Prague, Okla. 74864

[21] Appl. No.: 473,642

[22] Filed: Feb. 1, 1990

[51] Int. Cl.[5] ..... E02B 13/00

[52] U.S. Cl. ..... 405/36; 47/48.5; 405/107

[58] Field of Search ..... 405/19, 36, 39, 43, 405/45, 50, 107, 115; 47/48.5; 383/41, 72

[56] References Cited

U.S. PATENT DOCUMENTS

| | | | |
|---|---|---|---|
| 1,029,107 | 6/1912 | Couls | 405/39 |
| 1,355,740 | 10/1920 | Friend | 383/41 X |
| 1,553,241 | 9/1925 | Hickey | 383/41 X |
| 1,554,865 | 9/1925 | Magoon | 47/48.5 |
| 3,568,453 | 3/1971 | Ziegenmeyer | 405/115 X |
| 3,957,098 | 5/1976 | Hepworth et al. | 405/19 X |
| 4,573,204 | 2/1986 | Polett | 383/41 |
| 4,650,368 | 3/1987 | Bayer | 405/107 X |
| 4,790,387 | 12/1988 | Share et al. | 405/36 X |
| 4,799,821 | 1/1989 | Brodersen | 405/115 |

FOREIGN PATENT DOCUMENTS

| | | | |
|---|---|---|---|
| 422331 | 1/1935 | United Kingdom | 383/41 |

*Primary Examiner*—David H. Corbin

*Attorney, Agent, or Firm*—Laney, Dougherty, Hessin & Beavers

[57] ABSTRACT

A damming and barrier-forming device which includes a porous, biodegradable elongated fabric tube closable at one or both ends, and having a diameter of from four inches to two feet and a length of at least four feet. The elongated fabric tube, which can typically be constructed of burlap, is filled with earth after one end has been closed, and the earth-filled tube is then laid in a desired configuration adjacent or around a shrub or plant which is to be nourished and sustained by water impounded behind, or within, the damming and barrier-forming device. A method is described for using the damming and barrier-forming device.

4 Claims, 1 Drawing Sheet

DAMMING AND BARRIER-FORMING DEVICE AND METHOD

FIELD OF THE INVENTION

This invention relates to devices useful for establishing a dam or barrier to impound water adjacent plants to nourish the plants, and to a method of using such devices.

BACKGROUND OF THE INVENTION

1. Brief Description Of The Prior Art

Heretofore, when trees or shrubs have been planted, it has generally been thought sufficiently important to provide an adequate water supply for the roots of the plant that an earthen dam is constructed around the base of the plant at a radial distance of from one to five feet from the trunk of the plant. In some instances, the tree planter or the gardener who is to construct the dam removes soil for this purpose from a location too closely adjacent the trunk of the tree, thus risking some exposure of the roots of the tree.

Such dams or water impoundment structures, when formed of earth, and generally by the use of a spade to build up the earth, are susceptible to destruction or malfunction where heavy rains occur, and the soil within the dam or water impoundment is washed away to cause cuts or creases through the dam.

In some instances, the soil which is to be placed in the dam or water impoundment structure is located at a remote location with respect to the plant where the dam or water impoundment structure is to be formed. In these cases, the soil at the remote location is spaded up, or dug with other earth removing implements, placed on a truck and brought to the locus of the tree or plant where it is off-loaded and formed into the shape of the earthen dam or water impoundment structure.

2. Brief Description Of The Present Invention

The present invention provides an improved damming and barrier-forming device which can be used to establish a dam around the trunk or base of a tree or plant which will confine water to a location immediately adjacent the tree or plant and thus water the roots. The damming and barrier-forming device is self-contained and can be easily and quickly placed in position, and will retain soil forming a part of the device at the desired location over an extended period of time. Moreover, the damming and barrier-forming device can be picked up and re-shaped and even used on different trees at different times.

Broadly described, the damming and barrier-forming device of the invention includes an elongated, porous, preferably biodegradable fabric tube which is closable at one or preferably both ends, and which has a diameter of from about four inches to about two feet, and a length of at least four feet. In general, the larger the diameter of the fabric tube, the longer will be the length of the tube. The elongated fabric tube, which can typically be constructed of burlap, is filled with earth after one of its ends has been closed to prevent the earth from falling out of the tube. After the tube has been filled with earth, it is then laid in a desired configuration adjacent or around a tree or shrub which is to be nourished and sustained by water impounded behind, or within, the damming and barrier-forming device.

In one method of use of the device, it is first placed by the user on a reel in a length sufficient to form a dam, levy, barrier or impoundment of the various lengths which may be desired. It is then pulled off of the reel to a selected length, and that much of the tube is cut away from that which remains on the reel. One end of the severed section of tube is then closed by binder twine or other material which is provided at spaced intervals along the tube. The tube is then filled with dirt by the use of a trowel, small hand shovel or spade. The earth may be any type which is preferred for use on the ground around the tree or shrub in forming a dam or water impoundment. The filled tube is then curved or shaped into an arcuate configuration around the base of the tree or shrub so that it functions effectively to retain water at a desired location. It will generally be spaced away from the trunk of the tree by a selected distance. If the ground upon which it is laid is very hard, it may be desirable to dig a very small trench to lay it in. The ends of the tube preferably overlap and abut each other in order to optimize the performance of the tube. Due to the capability of the tube to withstand repetitive use on several different plants, the slight overlap (due to additional length of the tube not needed for a particular tree or shrub) may be needed at a slightly larger tree or shrub adjacent which the damming or barrier-forming structure of the invention is next to be used. The overlap also allows the dirt in adjacent, overlapped and touching end portions to bond together and prevent water leakage at this location.

An important object of the present invention is to provide a damming device which can be quickly and easily used by unskilled persons for the purpose of forming an effective, environmentally acceptable barrier adjacent a tree or shrub which is to be provided with a source of water impounded by the device.

Another object of the invention is to provide a soil containing tube which can be easily and manually shaped into a desired configuration, including one or more arcuate portions, and which has a long and trouble free operating life.

A further object of the invention is to provide a damming and barrier-forming device in the form of an elongated generally cylindrical tube which can be wrapped around the base of a tree or shrub which has just been planted in order to provide an adequate water supply to that plant as water is impounded by the tube.

Additional objects and advantages of the invention will become apparent as the following detailed description of the invention is read in conjunction with the accompanying drawings which illustrates one embodiment of the invention.

GENERAL DESCRIPTION OF THE DRAWINGS

DETAILED DESCRIPTION OF A PREFERRED EMBODIMENT OF THE INVENTION

Figure 1:
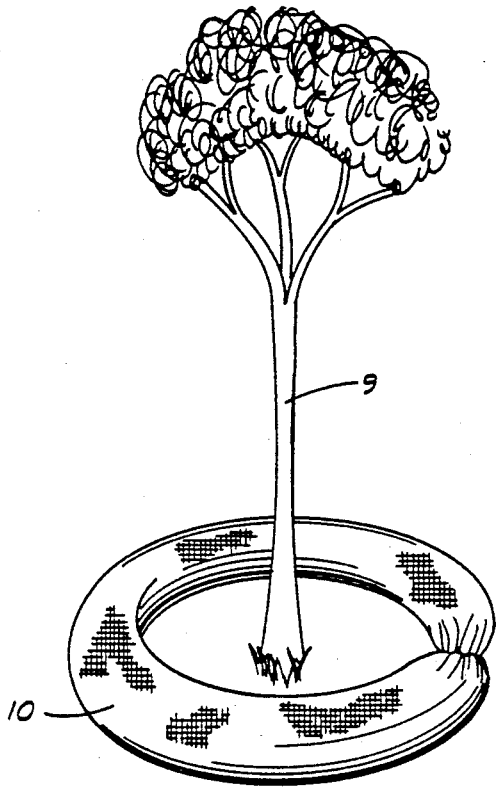
FIG. 1 depicts a typical use of the damming and barrierforming device of the invention as it is emplaced for the purpose of impounding water around the trunk of a tree to assure an adequate water supply to the roots of the tree.
Figure 2:
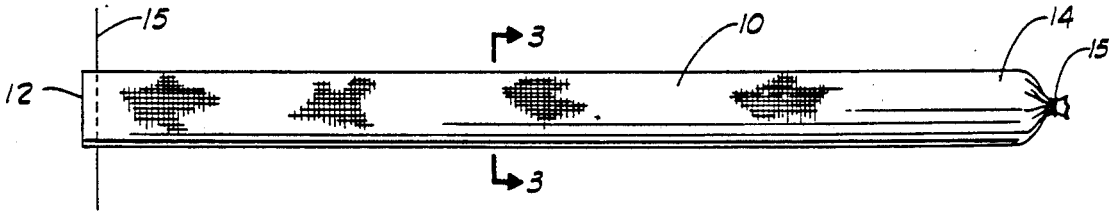
FIG. 2 is a side elevation view of a tubular structure forming the damming and barrier-forming device of the invention.
Figure 4:
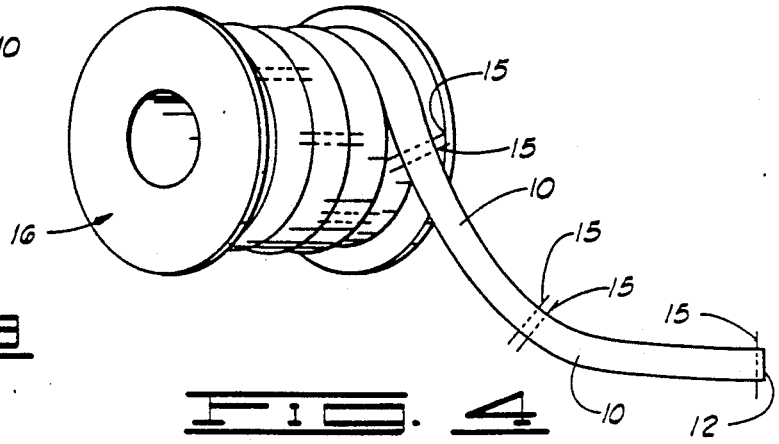
FIG. 4 is a front elevation view showing, somewhat schematically, a reel upon which one form of the tubular material used to form the damming and barrier-forming device of the invention is reeled in order to provide a supply of the same to a landscape architect or gardener who may be using a large amount of the damming or barrier-forming device in one of several modes of using the invention.

Referring initially to FIG. 1 of the drawings, the damming and barrier-forming device of the invention is shown as it typically appears when in place around a small tree 9. The device includes an elongated fabric tube 10 which is open at one end 12, and which is closed at its opposite end 14 in the course of its use in a manner hereinafter described. Closure of the tube 10 can be accomplished by the use of a string or cord 15 or any suitable inexpensive closure device which can be quickly drawn together manually to form a closure. Biodegradable binder twine is especially well suited for this purpose. The closure need only be adequate to prevent dirt or earth from passing through the tube and out of the closed end thereof. A section near the end of a tube 10 which carries a string closure element 15 which can be used to close the end adequately for use in the manner described, is shown in FIGS. 2 and 4 of the drawings.

Figure 3:
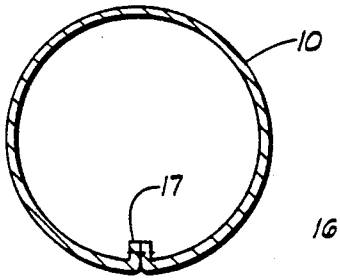
FIG. 3 is a sectional view taken along line 3—3 of FIG. 2.

It will be perceived in referring to FIG. 3 that the elongated fabric tube 10 is substantially cylindrical in distended cross-sectional configuration. Such tubes will normally be made with an elongated, axially extending seam 17 formed down one side of the tube for joining the edges of a flat blank at that location to form the tube.

Various materials of construction can be used in the formation of the elongated fabric tube 10. A preferred material, however, is burlap having a relatively high porosity or mesh size. The mesh size should not be large enough to permit dirt to pass rapidly and easily through the openings in the fabric. On the other hand, the fabric of which the elongated tube 10 is constructed should be sufficiently porous and water permeable to permit water to permeate the tube, and to dampen the soil inside the tube. At the same time, the mesh size of the fabric should be sufficiently small that a heavy down pour of rain will not cause the soil particles to be quickly washed out of the tube by passage through the pores of the material. I have found that so called burlap of 7 oz. to 12 oz. weight can be used, and that burlap having a weight of 10 oz. gives the best performance.

In one embodiment of the invention, the elongated fabric tube 10 may be made in lengths as great as 100–300 feet, particularly where a tube is of a diameter which is only from about 4 inches to about 1 foot in diameter. In such cases, an elongated tube 10 of the described length is wound up in a plurality of superimposed, flat convolutions or coils upon a reel 16. Such reels can be carried on a truck or vehicle of a landscape architect or gardener who is to use selected lengths of the elongated fabric tube in the development of the dam and water impounding barrier as described. Where the elongated fabric tube is of such considerable length, and is wound on a reel, the gardener or landscape architect who is about to use the tube for establishing a damming and barrier-forming device will first pull off a selected length of the tube. This will be a length which has been determined by measurement to be that which is needed to create a dam or barrier-forming device of adequate length to impound water at the desired location adjacent or around a tree or shrub. For example, where trees of approximately two years of age are being transplanted, an elongated fabric tube having a length of about 16 feet will be cut off of the reel. It is preferably cut at a location which is immediately adjacent, and on the downstream side of the closure string or twine 15 laced through the mesh or openings of the burlap or other material at longitudinal intervals along the length of the tube. Such locations are depicted on the tube 10 shown in FIGS. 2 and 4. The closure string or twine need not necessarily be laced into the tube, but can be kept separate and used when needed in less preferred embodiments of the invention.

After cutting away from the reeled tube the length of tube which is needed, the end of the tube is then sealed by drawing the string 15 or fastener element together around the tube. After this has been accomplished, filling of the tube with dirt is commenced. This can be done with a hand trowel, a shovel or spade, depending, in part, on the diameter of the tube which has been selected. The type of earth placed in the elongated tube 10 may not be particularly significant in many damming and barrierforming requirements, although in others, the type of soil used may be important, and selection of the proper soil may determine, in part, how well the damming device functions.

For example, if azalea plants are to be surrounded by the tubing filled with earth, and it is anticipated that the tube will function to allow the earth to gradually soak through the tubing, it would be preferred to provide a somewhat acid soil from a location where this can be obtained, rather than an alkaline soil, since azaleas are acid-loving plants. Other instances where the particular type of soil placed in the tube is of some importance will be discernible to those familiar with particular plan and soil requirements.

After the selected length of elongated tube 10 has been filled with the selected soil, another of the strings 15 can be used to close the open end of the tube. This is facilitated by locating the strings 15 in the manner shown in FIG. 4. The tube is then manually pulled to the site of the tree or shrub where it is to be used. Alternatively, it can be carried there on a truck, or pulled behind a tractor, especially where the fabric used in constructing the tube is heavy burlap, since this can be slid over the ground for some distance without the frictional wear quickly causing the burlap to fail.

When the elongated tube 10 is at the place where it is to be used, it is then placed on the ground and curved in an arcuate configuration. It is most often curved in an arcuate or generally circular configuration so that it surrounds the trunk of the tree in the manner illustrated in FIG. 1. In some instances, however, other shapes will be more useful, and can be just as easily, or perhaps even more easily, formed than the circular shape shown in FIG. 1. Thus, on the side of a hill, it may only be necessary to form an arcuate levy or barrier with the device of the invention in order to impound upstream water as needed to adequately water the plant. At other times, where it may be intended to re-use the elongated fabric tube to construct a dam, levy or barrier at more than one tree or plant, the greatest length of tube which may be required at any one of the plants is initially cut. The open end of the tube has been closed after filling with soil as described, and the ends of the tube are then overlapped for all of the smaller trees where the greater length necessary to accommodate the larger tree is unnecessary and not required. Overlapping is desirable in any event in order to better facilitate the joinder of end portions in a way which better avoid leakage of water at this point.

After the damming or barrier-forming device of the invention has been placed in position adjacent a tree or shrub, water from a garden hose or a sprinkler or bucket or the like can be placed behind the damming device. That is, the water can be placed against the concave side of the device and between that side of the device and the tree or shrub. This will hold the water at a location such that it cannot run away from the plant, and deprive the roots of the water necessary for good nutrition.

Any material used to form the damming and barrier-forming device is preferably biodegradable in the sense that it will, within a reasonable time, break down into soil compatible organic matter. Preferably, as in the case of the burlap material which is a preferred material of construction, complete deterioration and break down of the tubular material will occur in less than four years in the earthen environment, and most preferably, in not more than three years.

Although a preferred embodiment of the present invention has been herein described in order to afford an adequate understanding of the principles of the invention to facilitate their use by those having ordinary skill in this art, it will be appreciated that some changes and innovations in the structure illustrated, and the methodology described, can be brought about without relinquishment of, or departure from, these basic principles. Changes and innovations of that type are therefor deemed to be circumscribed by the spirit and scope of the invention except as the same may be necessarily limited by the appended claims or reasonable equivalents thereof.

What is claimed is:

1. A method for watering a plant comprising:
filling an elongated, porous, water permeable tube with friable soil sized to be retained in said tube while said tube is bent and curved;
closing both ends of the tube;
shaping and curving the tube to form a water-retaining dam around the plant; and
filling the area adjacent the tube and around the plant with water.

2. A method as defined in claim 1 in which said tube is shaped and curved into a circle, and including the further step of:
overlapping the end portions of the tube with said overlapped end portions abutted against each other.

3. A method for impounding water at a selected location around a plurality of plants comprising:
constructing an elongated porous, water permeable tube having a diameter of from about four inches to about one foot and having pairs of closure strings attached to the tube at longitudinally spaced intervals therealong for constricting the tube by the use of said strings;
reeling the elongated tube upon a reel for storage and for transport purposes;
transporting the reel to the locus of said plants where the water is to be impounded; then
unreeling a selected length of said tube from said reel at least sufficiently long to extend around one of said plants;
cutting said length of tube at a location between a selected pair of said closure strings; and
constructing the closure string on said selected length to close the end of said selected length of tubing adjacent the place where said tubing has been cut;
filling the selected length of tubing with dirt; and
placing said filled selected length of tube on the ground adjacent one of said plants in a selected configuration to impound water at a desired location adjacent said one plant; then
repeating said unreeling, cutting, constricting and filling steps for a second of said plants and using a second selected length of tube;
closing the open end of said dirt-filled second selected length of tube, utilizing the other closure string in said selected pair to effect closure of said open end; and then
placing said dirt-filled second selected length of tube on the ground adjacent said second plant in a selected configuration to impound water at a desired location adjacent said other plant.

4. A method for watering a plant comprising:
filling an elongated, tubular element with friable particles of soil sized to be retained in said elongated, tubular element while said tubular element is bent and curved to a desired shape;
closing both ends of the tube to retain the soil particles therewithin;
shaping and curving the tube to for ma water-retaining dam adjacent the plant; and
filling the area between the tube and the plant with water.

* * * * *

UNITED STATES PATENT AND TRADEMARK OFFICE

CERTIFICATE OF CORRECTION

PATENT NO. : 5,030,031

DATED : July 9, 1991

INVENTOR(S) : Howard L. Brown

It is certified that error appears in the above-identified patent and that said Letters Patent is hereby corrected as shown below:

In column 2, line 54, delete "barrierforming" and insert --barrier-forming--.
In column 4, line 20, delete "barrierforming' and isnert --barrier-forming--.
In column 6, line 44, delete "for ma" and insert --form a--.

Signed and Sealed this

Eighth Day of December, 1992

*Attest:*

DOUGLAS B. COMER

*Attesting Officer*

*Acting Commissioner of Patents and Trademarks*